US010807135B2

(12) United States Patent
Shindo et al.

(10) Patent No.: US 10,807,135 B2
(45) Date of Patent: Oct. 20, 2020

(54) SHAPED DIAMOND DIE

(71) Applicant: A.L.M.T. Corp., Tokyo (JP)

(72) Inventors: Toshiaki Shindo, Sumoto (JP); Takuya Asanuma, Sumoto (JP)

(73) Assignee: A.L.M.T. Corp., Tokyo (JP)

( * ) Notice: Subject to any disclaimer, the term of this patent is extended or adjusted under 35 U.S.C. 154(b) by 0 days.

(21) Appl. No.: 16/473,450

(22) PCT Filed: Dec. 8, 2017

(86) PCT No.: PCT/JP2017/044159
§ 371 (c)(1),
(2) Date: Jun. 25, 2019

(87) PCT Pub. No.: WO2018/123513
PCT Pub. Date: Jul. 5, 2018

(65) Prior Publication Data

US 2019/0329308 A1 Oct. 31, 2019

(30) Foreign Application Priority Data

Dec. 26, 2016 (JP) ..... 2016-251570

(51) Int. Cl.
*B21C 3/02* (2006.01)
*B21C 3/06* (2006.01)

(52) U.S. Cl.
CPC ..... *B21C 3/025* (2013.01); *B21C 3/06* (2013.01)

(58) Field of Classification Search
CPC .. B21C 1/00; B21C 3/02; B21C 3/025; B21C 3/04; B21C 3/06; B21C 3/18; B21C 25/10; B23P 15/24
See application file for complete search history.

(56) References Cited

U.S. PATENT DOCUMENTS 4,016,736 A * 4/1977 Carrison ..... B01J 3/062 72/41
4,260,397 A * 4/1981 Bovenkerk ..... C01B 32/25 423/446
4,374,900 A * 2/1983 Hara ..... B01J 3/062 419/11

(Continued)

FOREIGN PATENT DOCUMENTS

CN 2565557 Y 8/2003
CN 101588877 A 11/2009

(Continued)

OTHER PUBLICATIONS

Translation, JP 2005-254311 A, Sep. 2005.*

(Continued)

*Primary Examiner* — Edward T Tolan
(74) *Attorney, Agent, or Firm* — Baker Botts L.L.P.; Michael A. Sartori

(57) ABSTRACT

A shaped diamond die includes a polycrystalline diamond, the polycrystalline diamond having a machining hole, wherein a length D of a side of the machining hole is 100 μm or less, a corner R is 20 μm or less, the shaped diamond die includes a bearing portion, a surface roughness Sa of the bearing portion is 0.05 μm or less, and an average grain size of the polycrystalline diamond is 500 nm or less.

5 Claims, 6 Drawing Sheets

(56) References Cited

U.S. PATENT DOCUMENTS

| | | | | |
|---|---|---|---|---|
| 4,462,242 | A * | 7/1984 | Morgenthaler | B21C 3/025 425/183 |
| 5,957,005 | A * | 9/1999 | Einset | B21C 3/04 76/107.4 |
| 9,061,336 | B2 * | 6/2015 | Sumiya | B01J 3/062 |
| 9,601,336 | B2 * | 3/2017 | Zhou | H01L 29/42368 |
| 2003/0136171 | A1 | 7/2003 | Goto | |
| 2005/0104708 | A1 | 5/2005 | Goto et al. | |
| 2010/0043520 | A1 | 2/2010 | Sumiya et al. | |
| 2019/0060968 | A1 | 2/2019 | Sumiya et al. | |

FOREIGN PATENT DOCUMENTS

| | | | |
|---|---|---|---|
| CN | 104259230 | A | 1/2015 |
| EP | 2127769 | A1 | 2/2009 |
| JP | S48-057531 | U | 7/1973 |
| JP | H05-146820 | A | 6/1993 |
| JP | H09-220610 | A | 8/1997 |
| JP | 2003-220407 | A | 8/2003 |
| JP | 2003-245711 | A | 9/2003 |
| JP | 2005-150310 | A | 6/2005 |
| JP | 2005-254311 | A | 9/2005 |
| JP | 2008-290107 | A | 12/2008 |
| JP | 2008-290108 | A | 12/2008 |
| JP | 2009-119472 | A | 6/2009 |
| JP | 2010-149139 | A | 7/2010 |
| JP | 2015-093306 | A | 5/2015 |
| WO | 2017/073424 | A1 | 5/2017 |

OTHER PUBLICATIONS

Translation; CN 106191600 A; Dec. 7, 2016.*

CN 106191600 A, Dou et al. "Polycrystalline Wire Drawing Die", Dec. 7, 2016.*

Sumiya et al., "Innovative Ultra-hard Materials: Binderless Nano-polycrystalline Diamond and Nano-polycrystalline Cubic Boron Nitride," SEI Technical Review No. 188, 2016, pp. 15-19 (incl. English abstract) (Cited in the Specification).

Notification of the First Office Action issued in counterpart Chinese Patent Application No. 201780080469.2 dated Apr. 14, 2020.

Extended European Search Report issued in counterpart EP Patent Application No. 17885579.7 dated Jul. 2, 2020.

* cited by examiner

SHAPED DIAMOND DIE

TECHNICAL FIELD

The present invention relates to shaped diamond dies. The present application claims a priority based on Japanese Patent Application No. 2016-251570 filed on Dec. 26, 2016, the entire contents of which are incorporated herein by reference.

BACKGROUND ART

Shaped diamond dies have conventionally been disclosed in, for example, Japanese Patent Laying-Open No. 2005-254311 (PTL 1), Japanese Patent Laying-Open No. 2003-220407 (PTL 2), Japanese Patent Laying-Open No, 2003-245711 (PTL 3), Japanese Utility Model Laying-Open No. 48-57531 (PTL 4), Japanese Patent Laying-Open No. 2008-290107 (PTL 5), Japanese Patent Laying-Open No. 2008-290108 (PTL 6), and Japanese Patent Laying-Open No. 2005-150310 (PTL 7). Polycrystalline diamonds have conventionally been disclosed in "Innovative Ultra-hard Materials: Binderless Nano-polycrystalline Diamond and Nano-polycrystalline Cubic Boron Nitride," SEI Technical Review No. 188, January 2016 (NPL 1).

CITATION LIST

Patent Literature

PTL 1: Japanese Patent Laying-Open No. 2005-254311
PTL 2: Japanese Patent Laying-Open No. 2003-220407
PTL 3: Japanese Patent Laying-Open No. 2003-245711
PTL 4: Japanese Utility Model Laying-Open No. 48-57531
PTL 5: Japanese Patent Laying-Open No. 2008-290107
PTL 6: Japanese Patent Laying-Open No. 2008-290108
PTL 7: Japanese Patent Laying-Open No. 2005-150310

Non Patent Literature

NPL 1: "Innovative Ultra-hard Materials: Binderless Nano-polycrystalline Diamond and Nano-polycrystalline Cubic Boron Nitride," SET Technical Review No. 188, January 2016.

SUMMARY OF INVENTION

A shaped diamond die of the invention of the present application is a shaped diamond die including a polycrystalline diamond, the polycrystalline diamond having a machining hole, wherein a length of a side of the machining hole is 100 μm or less, a corner R is 20 μm or less, the shaped diamond die includes a bearing portion, a surface roughness Sa of the bearing portion is 0.05 μm or less, and an average grain size of the polycrystalline diamond is 500 nm or less.

DETAILED DESCRIPTION

Figure 1:
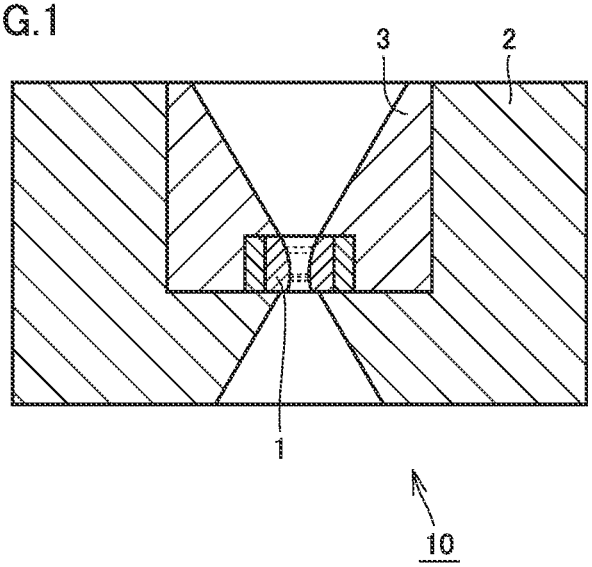
FIG. 1 is a sectional view of a shaped diamond die 10 according to Embodiment 1, a diamond 1 of shaped diamond die 10, a case 2 that houses diamond 1, and a sintered alloy 3 between case 2 and diamond 1.

Problem to be Solved by the Present Disclosure

A conventional technique suffers from a large surface roughness of a wire material after drawing.

The present invention has therefore been made to solve the above problem, and has an object to provide a shaped diamond die having a good surface roughness of a wire material after drawing.

DESCRIPTION OF EMBODIMENTS

Embodiments of the invention of the present application will initially be listed and described.

A shaped diamond die of the invention of the present application is a shaped diamond die including a polycrystalline diamond, the polycrystalline diamond having a machining hole, wherein a length of a side of the machining hole is 100 μm or less, a corner R is 20 μm or less, a surface roughness Sa of a bearing portion is 0.05 μm or less, and an average grain size of the polycrystalline diamond is 0.500 nm or less.

In the shaped diamond die configured as described above, since surface roughness Sa of the bearing portion is 0.05 μm or less and the average grain size of the polycrystalline diamond is 500 nm or less, the surface roughness of the wire material after drawing can be reduced.

Preferably, the shaped diamond die includes a reduction portion, and a surface roughness Sa of the reduction portion is 0.1 μm or less. The surface roughness of the reduction portion upstream of the bearing portion is small when surface roughness Sa of the reduction portion is 0.1 μm or less, thus reducing the surface roughness of the wire material after drawing.

Preferably, a surface of the machining hole extending from the reduction portion to the bearing portion is formed of a smooth curved surface. Since the surface of the machining hole extending from the reduction portion to the bearing portion is formed of a smooth curved line, the wire material runs smoothly from the reduction portion to the bearing portion.

Preferably, the polycrystalline diamond around the machining hole is the polycrystalline diamond extending as a unity continuously in a circumferential direction of the machining hole. In this case, since the polycrystalline diamond around the machining hole is the polycrystalline diamond extending as a unity continuously in the circumferential direction of the machining hole, it has a strength higher than that of a divided diamond. Consequently, the machining hole has high accuracy, leading to a reduced surface roughness of the wire material after drawing.

Preferably, the shaped diamond die is used in drawing of a wire material including a linear portion in a cross section perpendicular to a longitudinal direction of the wire material.

Preferably, a ratio of a binder to the polycrystalline diamond is 5 vol % or less. Since the ratio of the binder is 5 vol % or less, the ratio of the binder is reduced, thus leading to improved strength of the polycrystalline diamond.

Consequently, the machining hole has high accuracy, leading to a reduced surface roughness of the wire material after drawing.

DETAILED DESCRIPTION OF EMBODIMENTS

Embodiment 1

(Overall Configuration)

FIG. 1 is a sectional view of a shaped diamond die 10 according to Embodiment 1, a diamond 1 of shaped diamond die 10, a case 2 that houses diamond 1, and a sintered alloy 3 between diamond 1 and case 2. The summary of a diamond die for drawing of shaped wires will be described with reference to the drawings. FIG. 1 is a sectional view showing the diamond die that can be housed in a die case for use. Diamond 1 is housed in case 2. Diamond 1 is attached to case 2 using sintered alloy 3.

Figure 2:
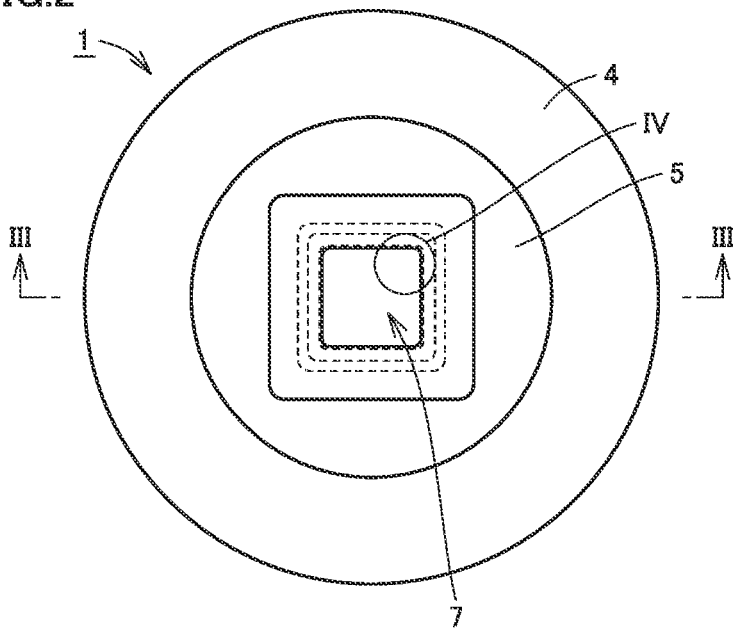
FIG. 2 is a front view of diamond 1 in FIG. 1.
Figure 3:
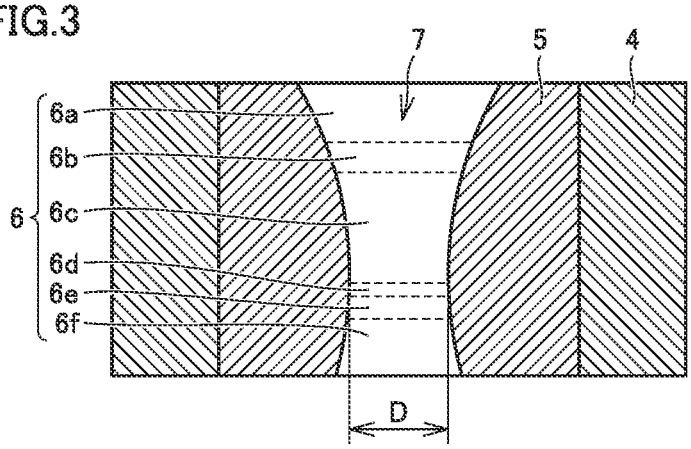
FIG. 3 is a sectional view taken along a line III-III in FIG. 2.
Figure 4:
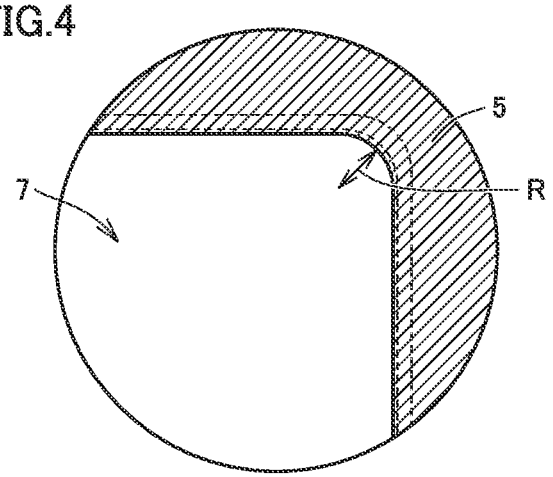
FIG. 4 shows a portion circled by IV in FIG. 2 in an enlarged manner.

FIG. 2 is a front view of diamond 1 in FIG. 1. FIG. 3 is a sectional view taken along a line in FIG. 2. FIG. 4 shows a portion circled by IV in FIG. 2 in an enlarged manner. As shown in FIGS. 2 to 4, diamond 1 has a polycrystalline diamond 5 surrounded by a support ring 4 made of cemented carbide. The central portion of diamond 1 is formed of a hole inner surface 6, through which a wire material to be drawn passes while being in contact therewith, and a machining hole 7. Hole inner surface 6 is further broken into parts, which is shown in FIG. 3 in detail. Hole inner surface 6 is divided into a bell portion 6*a*, an approaching portion 6*b*, a reduction portion 6*c*, a bearing portion 6*d*, a back relief portion 6*e*, and an exit portion 6*f* in order, and has a quadrangle shape as viewed from its front.

A surface of hole inner surface 6 formed by machining hole 7, which extends at least from bell portion 6*a* to bearing portion 6*d*, is formed of a smooth curved surface in a thickness direction of the diamond, Specifically, unlike a surface including bell portion 6*a*, approaching portion fib, reduction portion 6*c*, and bearing portion 6*d*, which are individually formed linearly and then rounded at a boundary therebetween, the whole of the respective portions is formed of a smooth curved surface. This curved surface is formed of a curved surface with single R or a curved surface with composite R, and a boundary therebetween is not clearly visible.

The wire diameter of the wire material drawn by shaped diamond die 10 is less than 0.1 mm, which is a small wire diameter. In drawing of such an ultra thin wire, when a surface extending from bell portion 6*a* to bearing portion 6*d* is formed of a smooth curved surface, the wire material does not undergo large changes in drawing resistance and is resistant to disconnection even though it is an ultra thin wire. Also, in supply of a lubricant, a surface formed of a smooth curved line leads to good lubrication conditions.

Polycrystalline diamond 5 around machining hole 7 is the polycrystalline diamond extending as a unity continuously in the circumferential direction of machining hole 7. Since polycrystalline diamond 5 around machining hole 7 is the polycrystalline diamond extending as a unity continuously on the circumference of the machining hole, it has a strength higher than that of a divided diamond. This leads to a high degree of accuracy of the machining hole, thereby reducing the surface roughness of the wire material after drawing.

(Length of Bearing Portion 6*d*)

The length of bearing portion 6*d* is preferably 0.05 D to 1.0 D, where D represents the distance between opposite surfaces of the front surface, which has a quadrangle shape, of bearing portion 6*d*. For further enhanced effects, the length is preferably 0.05 D to 0.8 D. In general, a longer length of the bearing portion is preferable from the viewpoint of longer life of shaped diamond die 10, that is, prevention of wear of, or prevention of shape change of polycrystalline diamond 5. In drawing of an ultra thin wire, however, the length of bearing portion 6*d* cannot be increased due to a significant problem of disconnection. For prevention of disconnection, measures need to be taken from two viewpoints, namely, a reduced contact area between polycrystalline diamond 5 and the wire material and a reduced frictional force per unit area. Thus, the length of bearing portion 6*d* is first reduced from the viewpoint of a reduced contact area of the wire material. Consequently, a frictional force is reduced. Also, providing a smooth curved surface reduces the contact area, which can prevent interruption of a supply of a lubricant and stabilize a drawing resistance, yielding a great effect of disconnection prevention. Also in polishing of bearing portion 6*d*, a larger length of bearing portion 6*d* makes it difficult to provide a smooth surface with a small surface roughness, but a small length of bearing portion 6*d* enables polishing with high accuracy, also yielding an effect of a stabilized drawing resistance.

(Surface Roughness Sa of Bearing Portion 6*d*)

Surface roughness Sa of bearing portion 6*d* needs to be 0.05 μm or less. Surface roughness Sa is defined in ISO 25178. The measurement range is a range including 20 or more peaks and valleys, Measurements are performed on the conditions that measurement pretreatment is performed, inclination correction is made, and Gaussian filter is not used. Bearing portion 6*d* is a portion which has the smallest diameter in machining hole 7, and the surface roughness of bearing portion 6*d* is deeply related to the surface roughness of a wire material. Surface roughness Sa of bearing portion 6*d* of more than 0.05 μm results in a large surface roughness of the wire material. In order to obtain a die with high accuracy and long life, surface roughness Sa of bearing portion 6*d* is preferably 0.03 μm or less and is most preferably 0.01 μm or less. It is more preferable as surface roughness Sa of bearing portion 6*d* becomes smaller. Note that from the perspective of industrial production considering cost-effectiveness, surface roughness Sa of bearing portion 6*d* is preferably 0.002 μm or more.

In order to measure surface roughness Sa of bearing portion 6*d*, a replica is produced; which is obtained by filling machining hole 7 of a shaped die with a transfer material e.g., RepliSet available from Marumoto Struers K. K.) and transferring the surface of machining hole 7 thereto. The resultant replica is observed under a laser microscope (e.g., VK-X series 3D laser scanning microscope available from KEYENCE CORPORATION), and surface roughness Sa is measured at any three points. An average value of surface roughnesses Sa at the three points is taken as surface roughness Sa of bearing portion 6*d*. Note that also for surface roughness Sa of a wire material after drawing, the surface is observed under the laser microscope, and surface roughness Sa is measured at any three points. An average value of surface roughnesses Sa at the three points is taken as surface roughness Sa of the wire material.

(Surface Roughness of Reduction Portion 6*c*)

Surface roughness Sa of reduction portion 6*c* is preferably 0.1 μm or less. Since the surface roughness of reduction portion 6*c* upstream of bearing portion 6*d* is small when surface roughness Sa of reduction portion 6*c* is 0.1 urn or less, the surface roughness of the wire material after drawing can be reduced.

In order to obtain a die with high accuracy and long life, surface roughness Sa of reduction portion 6*c* is preferably 0.05 μm or less and is most preferably 0.03 μm or less. It is more preferable as surface roughness Sa of reduction portion 6*c* becomes smaller. Note that from the perspective of industrial production considering cost-effectiveness, surface roughness Sa of reduction portion 6*c* is preferably 0.01 μm or more.

The surface roughness of reduction portion 6*c* is measured by a method similar to the method of measuring the surface roughness of bearing portion 6*d*.

(Length of Side and R of Corner Portion)

A wire material subjected to drawing is used for motor coils, for example. In such use, the wire material needs to be wound densely, and accordingly, smaller R of the corner portion of the wire material is more preferable. Thus, the quadrangle corner portion of the bearing portion has R of 20 μm or less. It is more preferable as R of the corner portion becomes smaller. Note that from the perspective of industrial production considering cost-effectiveness, R of the corner portion is preferably 1 μm or more.

Although the present embodiment illustrates a case in which machining hole 7 has a quadrangle shape, machining hole 7 is not limited to a quadrangle shape and may have any other polygonal shape such as a triangular shape or a hexagonal shape. It is preferable that linear portion be included in multiple cross sections perpendicular to the longitudinal direction of the wire material. Further, when the sides have different lengths, the length of the longest side is 100 μm or less. There is no lower limit on the length of the longest side. From the perspective of industrial production, however, an extremely small length of the longest side leads to a high manufacturing cost. Considering cost-effectiveness, thus, the length of the longest side is preferably 5 μm or more.

(Diamond Grain Size)

The diamond of polycrystalline diamond 5 needs to have a small grain size in order to reduce R. of the corner portion, and further reduce surface roughness Sa of bearing portion 6*d*. A polycrystalline diamond (sintered diamond) 5 having an average diamond grain size of 500 nm or less is used. The average grain size of the diamond also relates to the surface roughness of the wire material, and an average diamond grain size exceeding 500 nm leads to a large surface roughness of the wire material.

In order to provide a die with high accuracy and long life, the average grain size of the diamond is more preferably 300 nm or less, and is most preferably 100 nm or less. It is more preferable as the average grain size of the diamond becomes smaller. Note that an ultrafine diamond grain is costly, and accordingly, the diamond preferably has an average grain size of 5 nm or more from the perspective of industrial production.

In order to measure the average grain size of a diamond grain, three points of polycrystalline diamond 5 are photographed in the range of 5 μm×5 μm using a scanning electron microscope. Individual diamond grains are extracted from the photographed images, and the extracted diamond grains are binarized to calculate the area of each diamond grain. Then, assuming a circle having the same area as that of each diamond grain, the diameter of this circle is taken as the grain size of the diamond grain. An arithmetic mean value of the diameter of each diamond grain (the diameter of a circle) is taken as the average grain size.

(Binder)

Polycrystalline diamond 5 may contain a binder. The ratio of the binder to the polycrystalline diamond is preferably 5 vol % or less. In order to obtain a die with high accuracy and long life, the ratio of the binder is more preferably 3 vol % or less, and most preferably, no binder is contained.

In order to measure the ratio of the binder, any three positions of polycrystalline diamond 5 are photographed in the range of 5 μm×5 μm using the scanning electron microscope, as described in the above paragraph in "(Diamond Grain Size)". A photographed image is read by Adobe Photoshop or the like, a threshold that matches the original image is calculated by tracing a contour, and the image is subjected to black and white conversion. The area of the binder which appears white can be calculated through this black and white conversion. The diamond grain appears gray, and a grain boundary appears black. The area ratio of the binder is taken as the volume ratio of the binder, (Method of Manufacturing Shaped Diamond Die 10)

A sintered diamond is prepared as the material for shaped diamond die 10. This sintered diamond is machined into a cylindrical shape, and then, a pilot hole is made by laser machining. Subsequently, rough machining is performed by electric discharge machining. Subsequently, finishing is performed by lapping. Details of lapping are as follows.

1) A stainless steel wire, which has a rectangular sectional shape smaller than that of the machining hole and is rounded at each corner portion, is produced by rolling or the like.

2) A long side of the stainless steel wire is brought into contact with one side of a die hole, and the stainless steel wire is reciprocated while being supplied with a diamond slurry, followed by finishing. The other three sides are finished in a similar manner. In lapping, the stainless steel wire mainly machines the bearing portion. An amount of lapping of the reduction portion is adjusted, allowing adjustment of the surface roughness of the reduction portion as well.

Embodiment 2

Figure 5:
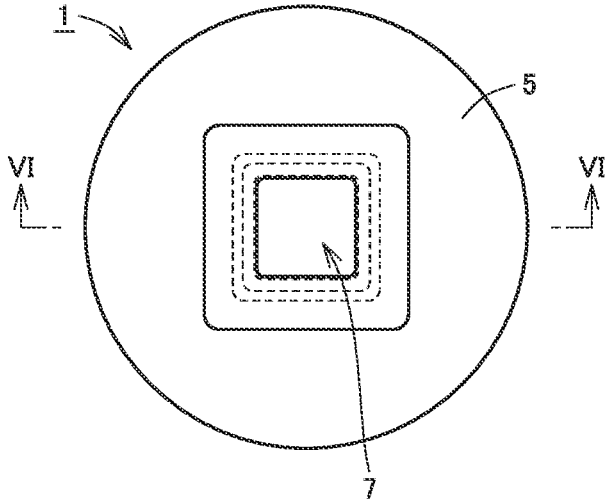
FIG. 5 is a front view of diamond 1 for use in a shaped diamond die according to Embodiment 2.
Figure 6:
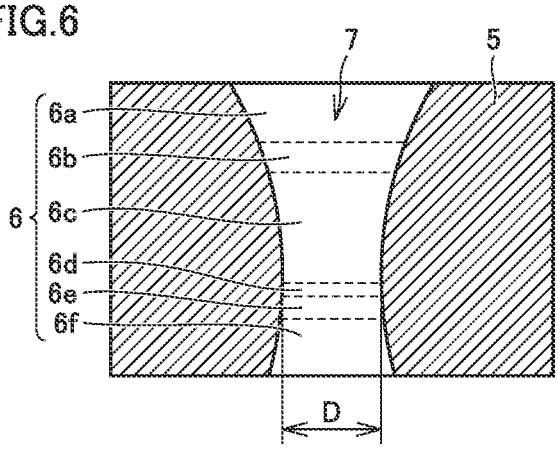
FIG. 6 is a sectional view taken along a line VI-VI in FIG. 5.

FIG. 5 is a front view of diamond 1 for use in a shaped diamond die according to Embodiment 2. FIG. 6 is a sectional view taken along a line VI-VI in FIG. 5.

Diamond 1 of the shaped diamond die according to Embodiment 2 differs from diamond 1 according to Embodiment 1 in that it is provided with no support ring.

Also in diamond 1 according to Embodiment 2 configured as described above, the effects similar to those of diamond 1 according to Embodiment 1 can be achieved.

Examples (Sample Numbers 1 to 8)

TABLE 1

| | Die specifications | | | | | | | Die |
|---|---|---|---|---|---|---|---|---|
| Sample No. | Length of opposite sides (μm) | Length of other opposite sides (μm) | R of corner portion (μm) | Surface roughness of bearing portion (μm Sa) | Average diamond grain size (nm) | Surface roughness of reduction portion (μm Sa) | Binder content (vol %) | performance Surface roughness of wire material after drawing |
| 1 | 100 | 100 | 20 | 0.05 | 600 | 0.1 | 5 | D |
| 2 | 100 | 100 | 20 | 0.05 | 520 | 0.1 | 5 | C |
| 3 | 100 | 100 | 20 | 0.05 | 500 | 0.1 | 5 | A |

TABLE 1-continued

| Sample No. | Die specifications: Length of opposite sides (μm) | Length of other opposite sides (μm) | R of corner portion (μm) | Surface roughness of bearing portion (μm Sa) | Average diamond grain size (nm) | Surface roughness of reduction portion (μm Sa) | Binder content (vol %) | Die performance: Surface roughness of wire material after drawing |
|---|---|---|---|---|---|---|---|---|
| 4 | 100 | 100 | 20 | 0.05 | 300 | 0.1 | 5 | A |
| 5 | 100 | 100 | 20 | 0.05 | 100 | 0.1 | 5 | A |
| 6 | 100 | 100 | 20 | 0.05 | 50 | 0.1 | 5 | A |
| 7 | 100 | 100 | 20 | 0.05 | 30 | 0.1 | 5 | A |
| 8 | 100 | 100 | 20 | 0.05 | 30 | 0.12 | 5 | B |

Shaped diamond dies of sample numbers 1 to 8, which have the shape shown in FIGS. 1 to 4 and have numeric values set variously, were prepared.

The shaped diamond die of sample number 3 was produced by the following method. First, a pilot hole was made in a polycrystalline diamond by laser machining, followed by rough machining through electrical discharge machining. Subsequently, finishing was performed by lapping. In lapping, first, a stainless steel wire having a rectangular cross-sectional shape of 95 μm×50 μm and having corner portions, each of which is rounded by R20 μm, was produced by rolling. A 95-μm side of this stainless steel wire was brought into contact with one side of the die hole, and the stainless steel wire was reciprocated while being supplied with a diamond slurry (containing a diamond having a grain size of 0.2 μm), followed by finishing. The other three sides were finished in a similar manner. The bearing portion of the shaped diamond die finished as described above had a surface roughness Sa of 0.05 μm. The shaped diamond dies of the other sample numbers were produced by a similar method.

A rectangular wire which has a side of 105 μm and is made of copper was drawn (drawing speed of 10 m/min.) in a lubricant and was tested. The surface roughness of the wire material perpendicular to the drawing direction of the rectangular wire after one-hour drawing was evaluated. Table 1 shows the results of the evaluations.

Assuming that surface roughness Sa of the rectangular wire drawn by the shaped diamond die of sample number 3 is one, a sample having a relative value of surface roughness Sa of 0.8 to 1 was evaluation A, a sample having a relative value of surface roughness Sa of more than one and equal to or less than 1.1 was evaluation B, a sample having a relative value of surface roughness Sa of more than 1.1 and equal to or less than 1.3 was evaluation C, and a sample having a relative value of surface roughness Sa of more than 1.3 was evaluation D.

Table 1 revealed that the average diamond grain size of 500 μm or less resulted in preferable characteristics (the surface roughness of the wire material is A or B). Table 1 further revealed that the surface roughness of the reduction portion also affects the surface roughness of the wire material and that the surface roughness of the reduction portion is more preferably 0.1 μm or less.

(Sample Numbers 11 to 15)

TABLE 2

| Sample No. | Die specifications: Length of opposite sides (μm) | Length of other opposite sides (μm) | R of corner portion (μm) | Surface roughness of bearing portion (μm Sa) | Average diamond grain size (nm) | Surface roughness of reduction portion (μm Sa) | Binder content (vol %) | Die performance: Surface roughness of wire material after drawing |
|---|---|---|---|---|---|---|---|---|
| 11 | 100 | 100 | 15 | 0.1 | 500 | 0.1 | 3 | D |
| 12 | 100 | 100 | 15 | 0.07 | 500 | 0.1 | 3 | C |
| 13 | 100 | 100 | 15 | 0.05 | 500 | 0.1 | 3 | A |
| 14 | 100 | 100 | 15 | 0.02 | 500 | 0.1 | 3 | A |
| 15 | 100 | 100 | 15 | 0.01 | 500 | 0.1 | 3 | A |

Shaped diamond dies of sample numbers 11 to 15 shown in Table 2, which have the shape shown in FIGS. 1 to 4 and have numeric values set variously, were prepared.

As to sample number 11, first, a pilot hole was made in a polycrystalline diamond by laser machining, followed by rough machining through electrical discharge machining. Subsequently, finishing was performed by tapping. In lapping, first, a stainless steel wire having a square cross-sectional shape of 105 μm×105 μm and having corner portions, each of which is rounded by R15 μm, was produced by rolling. Then, an attempt was made to finish the stainless steel wire by bringing the stainless steel wire into contact with the entire circumference of a dice hole and reciprocating the stainless steel wire while supplying a diamond slurry (containing a diamond having a grain size of 0.2 μm) thereto. However, finishing was interrupted due to the frequent occurrence of disconnections of the stainless steel wire. The bearing portion of the shaped diamond die had a surface roughness Sa of 0.1 μm.

The method of producing sample number 12 differs from the method of producing sample number 11 in that sample number 12 was lapped using a stainless steel wire having a square cross-sectional shape of 103 μm×103 μm and having corner portions, each of which is rounded by R15 μm. Finishing was interrupted due to the frequent occurrence of disconnections of the stainless steel wire. The bearing portion of the shaped diamond die had a surface roughness Sa of 0.07 μm.

As to sample number 13, a pilot hole was made in a polycrystalline diamond by laser machining, followed by rough machining through electrical discharge machining. Subsequently, finishing was performed by lapping. In lapping, first, a stainless steel wire having a rectangular cross-sectional shape of 95 μm×50 μm and having corner portions, each of which is rounded by R15 μm, was produced by rolling. A side of 95 μm of this stainless steel wire was brought into contact with one side of the die hole, and the stainless steel was reciprocated while being supplied with a diamond slurry (containing a diamond having a grain size of 0.2 μm), followed by finishing. The other three sides were finished in a similar manner. The bearing portion of the shaped diamond die finished as described above had a surface roughness Sa of 0.05 μm.

As to sample numbers 14 and 15, the grain size of a diamond in a diamond slurry was made to be less than 0.2 pin in the method of manufacturing sample number 13, thereby obtaining surface roughnesses Sa of the bearing portions of 0.02 μm and 0.01 μm, respectively.

The drawing conditions were identical to the drawing conditions of sample numbers 1 to 8.

Assuming that surface roughness Ra of a rectangular wire of sample number 13 after drawing is one, a sample having a relative value of surface roughness Sa of 0.8 to 1 was evaluation A, a sample having a relative value of surface roughness Sa of more than one and equal to or less than 1.1 was evaluation B, a sample having a relative value of surface roughness Sa of more than 1.1 and equal to or less than 1.3 was evaluation C, and a sample having a relative value of surface roughness Sa of more than 1.3 was evaluation D. Table 2 contains no evaluation B.

Table 2 revealed that the surface roughness of the bearing portion of 0.05 μm or less resulted in preferable characteristics.

(Sample Numbers 21 to 25)

TABLE 3

| | Die specifications | | | | | | | Die |
|---|---|---|---|---|---|---|---|---|
| Sample No. | Length of opposite sides (μm) | Length of other opposite sides (μm) | R of corner portion (μm) | Surface roughness of bearing portion (μm Sa) | Average diamond grain size (nm) | Surface roughness of reduction portion (μm Sa) | Binder content (vol %) | performance Surface roughness of wire material after drawing |
| 21 | 65 | 65 | 20 | 0.1 | 30 | 0.2 | not contained | D |
| 22 | 65 | 65 | 15 | 0.08 | 30 | 0.15 | not contained | C |
| 23 | 65 | 65 | 12 | 0.05 | 30 | 0.1 | not contained | A |
| 24 | 65 | 65 | 10 | 0.03 | 30 | 0.08 | not contained | A |
| 25 | 65 | 65 | 8 | 0.01 | 30 | 0.05 | not contained | A |

Shaped diamond dies of sample numbers 21 to 25 shown in Table 3, which have the shape shown in FIGS. 1 to 4 and have numeric values set variously, were prepared.

The method of manufacturing sample number 21 differs from the method of manufacturing sample number 11 in that sample number 21 was lapped using a stainless steel wire having a square cross-sectional shape of 70 μm×70 μm and having corner portions, each of which is rounded by R20 μm. Finishing was interrupted due to the frequent occurrence of disconnections of the stainless steel wire. The bearing portion of the shaped diamond die had a surface roughness Sa of 0.1 μm.

The method of manufacturing sample number 22 differs from the method of manufacturing sample number 11 in that sample number 22 was lapped using a stainless steel wire having a square cross-sectional shape of 70 μm×70 μm and having corner portions, each of which is rounded by R15 μm. Finishing was interrupted due to the frequent occurrence of disconnections of the stainless steel wire. The bearing portion of the shaped diamond die had a surface roughness Sa of 0.08 μm.

The shaped diamond die of sample number 23 was produced by the following method. First, a pilot hole was made in a polycrystalline diamond by laser machining, followed by rough machining through electrical discharge machining. Subsequently, finishing was performed by lapping. In lapping, first, a stainless steel wire having a rectangular cross-sectional shape of 60 μm×30 μm and having corner portions, each of which is rounded by R12 μm, was produced by rolling. A side of 60 μm of this stainless steel wire was brought into contact with one side of the die hole, and the stainless steel wire was reciprocated while being supplied with a diamond slurry (containing a diamond having a grain size of 0.2 μm), followed by finishing. The other three sides were finished in a similar manner. The bearing portion of the shaped diamond die finished as described above had a surface roughness Sa of 0.05 μm.

As to sample numbers 24 and 25, R of the corner portion of the stainless steel wire was set to 10 μm and 8 μm, respectively, and the grain size of the diamond of the diamond slurry was set to be less than 0.2 μm in the method of manufacturing sample number 23, so that R of the corner portion was 10 μm and 8 μm and surface roughness μm Sa of the bearing portion was 0.03 μm and 0.01 μm, respectively.

A rectangular wire which has a side of 68 μm and is made of copper was drawn (drawing speed of 10 m/min.) in a lubricant and was tested. The surface roughness of the wire material perpendicular to the drawing direction of the rectangular wire after one-hour drawing was evaluated. Assuming that the surface roughness of the rectangular wire of sample number 33 subjected to drawing is one, a sample having a relative value of surface roughness Sa of 0.8 to 1 was evaluation A, a sample having a relative value of surface roughness Sa of more than one and equal to or less than 1.1 was evaluation B, a sample having a relative value of surface roughness Sa of more than 1.1 and equal to or less than 1.3 was evaluation C, and a sample having a relative value of surface roughness Sa of more than 1.3 was evaluation D. Table 3 contains no evaluation B.

Table 3 revealed that the surface roughness of the bearing portion of 0.05 μm or less resulted in preferable characteristics.

(Sample Numbers 31 to 35)

TABLE 4

| Sample No. | Die specifications: Length of opposite sides (μm) | Length of other opposite sides (μm) | R of corner portion (μm) | Surface roughness of bearing portion (μm Sa) | Average diamond grain size (nm) | Surface roughness of reduction portion (μm Sa) | Binder content (vol %) | Die performance: Surface roughness of wire material after drawing |
|---|---|---|---|---|---|---|---|---|
| 31 | 80 | 80 | 120 | 0.05 | 30 | 0.1 | 7 | B |
| 32 | 80 | 80 | 15 | 0.05 | 30 | 0.1 | 5 | A |
| 33 | 80 | 80 | 12 | 0.05 | 30 | 0.1 | 3 | A |
| 34 | 80 | 80 | 10 | 0.05 | 30 | 0.1 | 2 | A |
| 35 | 80 | 80 | 8 | 0.05 | 30 | 0.1 | 0 | A |

Shaped diamond dies of sample numbers 31 to 35 shown in Table 4, which have the shape shown in FIGS. 1 to 4 and have numeric values set variously, were prepared.

The shaped diamond die of sample number 31 was produced in the following method. First, a pilot hole was made in a polycrystalline diamond by laser machining, followed by rough machining through electrical discharge machining. Subsequently, finishing was performed by lapping. In lapping, first, a stainless steel wire having a rectangular cross-sectional shape of 75 μm×40 μm and having corner portion, each of which is rounded by R20 μm, was produced by rolling. A 75-μm side of this stainless steel wire was brought into contact with one side of the die hole, and the stainless steel wire was reciprocated while being supplied with a diamond slurry (containing a diamond having a grain size of 0.2 μm), followed by finishing. The other three sides were finished in a similar manner. The bearing portion of the shaped diamond die finished as described above had a surface roughness Sa of 0.05 μm.

The method of manufacturing sample numbers 32 to 35 differs from the method of manufacturing sample number 31 in that sample numbers 32 to 35 were lapped using stainless steel wires having R of the corner portion of 15 μm, 12 μm, 10 μm, and 8 μm, respectively, in the method of manufacturing sample number 31.

A rectangular wire which has a side of 84 μm and is made of copper was drawn (drawing speed of 10 m/min.) in a lubricant and was tested. The surface roughness of the wire material perpendicular to the drawing direction of the rectangular wire after one-hour drawing was evaluated.

Assuming that surface roughness Sa of the rectangular wire of sample number 33 subjected to drawing is one, a sample having a relative value of surface roughness Sa of 0.8 to 1 was evaluation A, and a sample having a relative value of surface roughness Sa of more than 1.1 and equal to or less than 1.1 was evaluation B.

Table 4 revealed that the binder content of 5 vol % or less results in more preferable characteristics.

It should be understood that the embodiments and examples disclosed herein have been presented for the purpose of illustration and non-restrictive in every respect. It is intended that the scope of the present invention is not limited to the description above but defined by the scope of the claims and encompasses all modifications equivalent in meaning and scope to the claims.

REFERENCE SIGNS LIST

1 diamond, 2 case, 3 sintered alloy, 4 support ring made of alloy, 5 polycrystalline diamond, 6 hole inner surface, 6*a* bell portion, 6*b* approaching portion, 6*c* reduction portion, 6*d* bearing portion, 6*e* back relief portion, 6*f* exit portion, 7 machining hole, 10 shaped diamond die.

The invention claimed is:

1. A shaped diamond die comprising a polycrystalline diamond, the polycrystalline diamond having a machining hole, wherein a length of a side of the machining hole is 100 μm or less, a corner R is 20 μm or less, the shaped diamond die includes a bearing portion, a surface roughness Sa of the bearing portion is 0.05 μm or less, an average grain size of the polycrystalline diamond is 500 nm or less, the polycrystalline diamond includes a binder, and a ratio of the binder to the polycrystalline diamond is more than 0 vol % and 5 vol % or less, and the machining hole including a linear portion in a cross section perpendicular to a longitudinal direction of a wire material.

2. The shaped diamond die according to claim 1, wherein the shaped diamond die includes a reduction portion, and a surface roughness Sa of the reduction portion is 0.1 μm or less.

3. The shaped diamond die according to claim 2, wherein a surface of the machining hole extending from the reduction portion to the bearing portion is formed of a smooth curved surface.

4. The shaped diamond die according to claim 1, wherein the polycrystalline diamond around the machining hole is the polycrystalline diamond extending as a unity continuously in a circumferential direction of the machining hole.

5. The shaped diamond die according to claim 1, which is used in drawing of the wire material.

* * * * *